US008633369B2

(12) United States Patent
Kim

(10) Patent No.: US 8,633,369 B2
(45) Date of Patent: Jan. 21, 2014

(54) METHOD AND SYSTEM FOR REMOTE CONCERT USING THE COMMUNICATION NETWORK

(75) Inventor: Jae-Hoon Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 6 days.

(21) Appl. No.: 13/343,807

(22) Filed: Jan. 5, 2012

(65) Prior Publication Data

US 2012/0174738 A1 Jul. 12, 2012

(30) Foreign Application Priority Data

Jan. 11, 2011 (KR) ..... 10-2011-0002558

(51) Int. Cl.
*G10H 7/00* (2006.01)

(52) U.S. Cl.
USPC ..... 84/645

(58) Field of Classification Search
USPC ..... 84/645
See application file for complete search history.

(56) References Cited

U.S. PATENT DOCUMENTS

| | | | | |
|---|---|---|---|---|
| 5,530,859 | A * | 6/1996 | Tobias et al. | 713/400 |
| 6,067,566 | A * | 5/2000 | Moline | 709/219 |
| 6,141,324 | A * | 10/2000 | Abbott et al. | 370/236 |
| 6,898,637 | B2 * | 5/2005 | Curtin | 709/231 |
| 6,898,729 | B2 * | 5/2005 | Virolainen et al. | 714/4.1 |
| 7,012,185 | B2 * | 3/2006 | Holm et al. | 84/645 |
| 7,122,731 | B2 * | 10/2006 | Isozaki | 84/615 |
| 7,254,644 | B2 * | 8/2007 | Norimatsu et al. | 709/248 |
| 7,297,858 | B2 * | 11/2007 | Paepcke | 84/609 |
| 7,396,993 | B2 * | 7/2008 | Tada | 84/645 |
| 7,420,112 | B2 * | 9/2008 | Juszkiewicz et al. | 84/600 |
| RE42,565 | E * | 7/2011 | Paepcke | 84/609 |
| 8,044,289 | B2 * | 10/2011 | Toledano et al. | 84/600 |
| 2002/0007719 | A1 * | 1/2002 | Hasegawa | 84/609 |
| 2004/0154460 | A1 * | 8/2004 | Virolainen et al. | 84/645 |
| 2004/0154461 | A1 * | 8/2004 | Havukainen et al. | 84/645 |
| 2004/0159219 | A1 * | 8/2004 | Holm et al. | 84/645 |
| 2005/0150362 | A1 * | 7/2005 | Uehara | 84/645 |
| 2006/0123976 | A1 * | 6/2006 | Both et al. | 84/600 |
| 2006/0218239 | A1 * | 9/2006 | Umezawa et al. | 709/209 |
| 2007/0140510 | A1 * | 6/2007 | Redmann | 381/97 |
| 2007/0283799 | A1 * | 12/2007 | Carruthers et al. | 84/645 |

FOREIGN PATENT DOCUMENTS

| | | | |
|---|---|---|---|
| JP | 2008-304821 | A | 12/2008 |
| KR | 10-2001-0082593 | A | 8/2001 |

* cited by examiner

*Primary Examiner* — Jeffrey Donels
(74) *Attorney, Agent, or Firm* — Cha & Reiter, LLC

(57) ABSTRACT

A method and system for remote concert ensemble using a communication network is disclosed. The remote concert system comprises a server; and a plurality of terminals connected to the server, wherein the terminals transmit a MIDI signal to the server after generating the MIDI signal in accordance with the input of a recital signal, and the server transmits a received MIDI signal to the plurality of terminals synchronically and each of the terminals outputs the MIDI signal received from the server via a corresponding sound source.

12 Claims, 6 Drawing Sheets

METHOD AND SYSTEM FOR REMOTE CONCERT USING THE COMMUNICATION NETWORK

CLAIM OF PRIORITY

The present application claims, pursuant to 35 U.S.C. §119 (a), priority to, and the benefit of the earlier filing date of, that Korean patent application filed in the Korean Intellectual Property Office on Jan. 11, 2011 and assigned Serial No. 10-2011-0002558, the entire disclosure of which is hereby incorporated by reference.

BACKGROUND OF THE INVENTION

1. Field of the Invention

The present invention relates to the field for mobile communications and more particularly to a method and system for using a communication network for musicians.

2. Description of the Related Art

Portable terminals, such as a mobile communication terminal, an electronic scheduler, and a complex terminal and so forth, have become a necessity of our modern society as portable terminals have become an important means of information conveyance.

Mobile terminals now provide various multimedia services, and have been produced to satisfy the various multimedia services. However, as the needs of users concerning these multimedia services and terminals is growing more and more, the uses of the portable terminals require additional resources and tax the available resources.

For example, as users are interested in the music, a terminal has been held a simply music playback function as well as a musical instrument function.

That is, a user can play a tune on the song like a musical instrument by using the terminal. However, as more users enjoy the same song or instrument, the song may be played by an ensemble of players by using more than two terminals. However, there is a spatial limitation because users congregate in a predetermined place to enjoy playing together.

However, sometimes it is inconvenient or impractical for all the players to get together in one place. Hence, there is a need in the industry for allowing multiple players to come together, over a network, to collectively play their music.

SUMMARY OF THE INVENTION

To address the above-discussed deficiencies of the prior art, it is a primary object to provide a remote concert method and system capable of ensemble using a communication network without limitation of the place or location of the users (players, musicians).

Another aspect of the present invention is to provide a remote concert method and system that is capable of providing an ensemble in real time using a communication network to share a MIDI (Musical Instrument Digital Interface) signal.

Still another aspect of the present invention is to provide a remote concert method and system so that all terminals can share a MIDI signal outputted from a random terminal in real time by using a communication network.

In accordance with an aspect of the present invention, a remote concert system comprises a server; and a plurality of terminals connected to the server, wherein the terminals transmit a MIDI signal to the server after generating the MIDI (Musical Instrument Digital Interface) signal in accordance with the input of a recital signal, the server transmits a received MIDI signal to the plurality of terminals, wherein each of the terminals outputs the MIDI signal received from the server via a corresponding sound source.

In accordance with another aspect of the present invention, a remote concert method using a server and a plurality of terminals connected to the server via a communication network, comprises the steps of: connecting terminals for ensemble playing to the server via the communication network; sending a MIDI (Musical Instrument Digital Interface) signal to the server after generating the MIDI (Musical Instrument Digital Interface) signal in accordance with an input of a recital signal in one of the terminals; transmitting the MIDI signal received by the server to the plurality of terminals; and each of the terminals outputting the MIDI signal received from the server via a corresponding sound source in terminals.

In accordance with the principles of the invention, there is discloses a terminal comprising, a communication unit, an input device, an output device; and a controller for receiving an instrumental signal input, converting the received instrumental signal to a MIDI signal, transmitting the MIDI signal through the communication unit, receiving a united MIDI signal through the communication unit, the united MIDI signal representing a synchronized MIDI signal, extracting a MIDI signal from the united MIDI signal corresponding to the terminal, and outputting the extracted MIDI signal through the output device.

Before undertaking the detailed description of the invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

Throughout the drawings, like reference numerals will be understood to refer to like parts, components and structures.

DETAILED DESCRIPTION

The exemplary embodiments of the present invention will be described hereinafter with reference to the accompanying drawings. In the following description, well-known functions or constructions are omitted in case that a detailed description the well-known functions or constructions is judged to obscure a major point of the invention. In addition, aftermentioned terminology is a terminology to be defined by taking into account the function in the present invention, it can be changed by a user, the intension of an operator or customized etc. Therefore, this definition is issued based on all covered contents of the specification.

The present invention relates to a method and system for remote concert, and more particularly to a method and system for remote concert capable of having an ensemble of musicians (or persons) using a communication network. The remote concert system according to the present invention can be a shared MIDI signal generated by an unspecified terminal in all terminals in real time by using a communication network.

Figure 1:
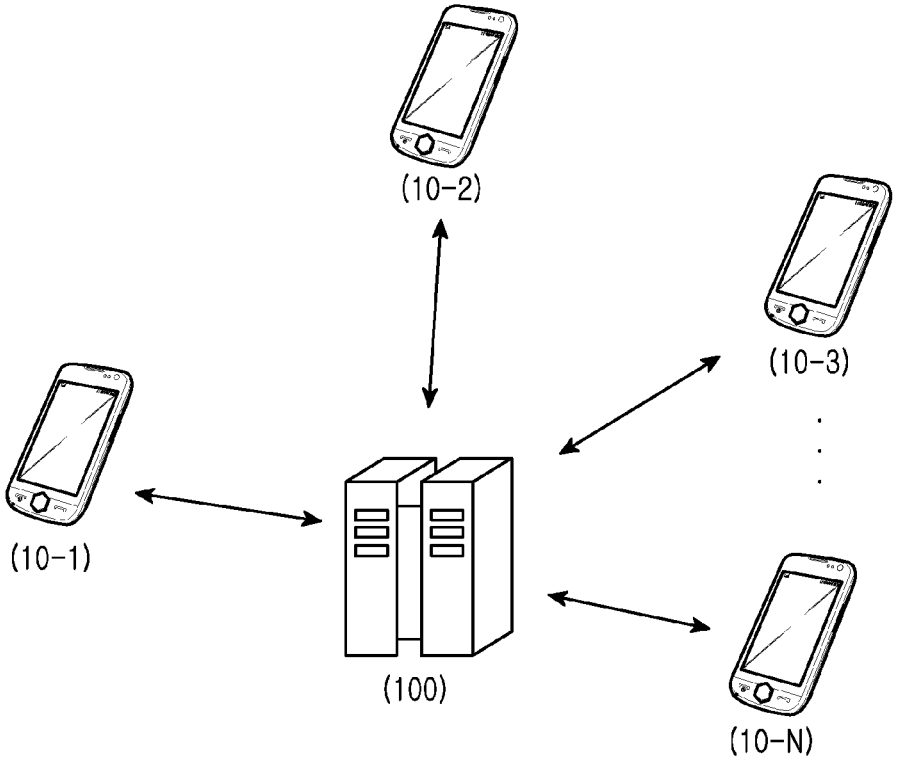
FIG. 1 is a figure illustrating a remote concert system according to the present invention.

FIG. 1 is a figure illustrating a remote concert system according to the present invention.

Referring to FIG. 1, the remote concert system according to the present invention includes a server 100, and a plurality of terminals 10-*n* (10-1, 10-2, 10-3 . . . 10-N) connected to a network. As shown in FIG. 1, the terminals 10-*n* and the server 100 communicate with a star topology network. One of the terminals 10-*n* can be operated as a host by being replaced with the server 100. For example, when an unspecified terminal 10-1 consists of a host, the remaining terminals can consist of client terminals of the host terminal 10-1.

The terminals 10-*n* are embedded with a plurality of sound sources. The sound source is to express the sound, though a MIDI signal, which is further described in detail later. The MIDI signal is outputted through the sound source. For example, the MIDI signal is outputted as a sound of musical instruments, such as a guitar, a keyboard instrument a drum and so forth through the sound source. The sound source can be classified as a GM (General MIDI) sound source, a GS sound source, and XG sound source (GS and XG sound sources are extended, proprietary MIDI formats) and so forth in accordance with the form of the MIDI signal. Thus, when the terminals 10-*n*, according to an embodiment of the present invention, inputs a recital signal of a corresponding musical instrument, the terminal outputs and transmits a MIDI signal corresponding to the input to the server 100.

The server 100 transmits a recently received MIDI signal received from an unspecified terminal 10-*n* to all terminals 10-1, 10-2, 10-3 . . . 10-N. Also, the server 100 simultaneously transmits a simultaneously received MIDI signals from at least two or more unspecified terminals to all terminals 10-1, 10-2, 10-3 . . . 10-N. At this time, the server 100 performs synchronization procedure coincided with the time (timing relationship) to receive and transmit the MIDI signal with all terminals 10-1, 10-2, 10-3 . . . 10-N. That is, the server 100 promptly transmits, without or with minimum delay, the MIDI signal from the unspecified terminal 10-*n* to all terminals 10-1, 10-2, 10-3 . . . 10-N upon receiving the MIDI signal from the terminal.

Each of the terminals 10-1, 10-2, 10-3 . . . 10-N output, through a corresponding sound source, a recently received MIDI signal orderly from the server 100. Also, the terminals 10-1, 10-2, 10-3 . . . 10-N output at least two or more MIDI signals which are simultaneously received from the server 100.

For example, if terminal 10-1 inputs a recital signal corresponding to a related syllable of the keyboard instrument, the terminal 10-1 generates and transmits a corresponding MIDI signal to the server 100. The server 100 synchronizes and transmits the MIDI signal to all terminals 10-1, 10-2, 10-3 . . . 10-N. Each of the terminals 10-1, 10-2, 10-3 . . . 10-N output the sound through a sound source corresponding to a syllable of the instruments the MIDI signal received from the server.

For example, if the server 100 simultaneously receives two MIDI signals corresponding to a keyboard instrument and a drum from the terminals 10-1 and 10-2, the server 100 synchronizes and transmits two MIDI signals to each of the terminals 10-1, 10-2, 10-3, . . . , 10-N. Each of the terminals 10-1, 10-2, 10-3 . . . 10-N, then output a respective sound corresponding to a sound source of the keyboard instrument and the drum of the MIDI signal received from the server.

That is, the remote concert system according to an exemplary embodiment of the present invention is able to share the MIDI signals in real time through the server 100 of the communication network and to play music by the ensemble of players (terminals).

Figure 2:
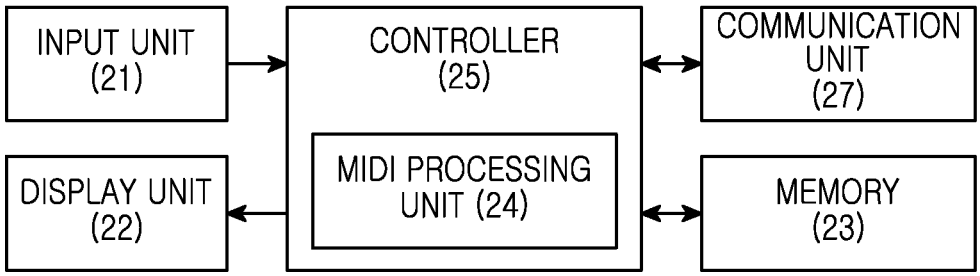
FIG. 2 is a block diagram of terminal according to an embodiment of the present invention.

FIG. 2 is a block diagram of terminal according to an embodiment of the present invention.

Referring to FIG. 2, the terminal comprises an input unit 21 for inputting data; an output unit 22 for outputting data; a memory 23 for storing data; a communication unit 27 for communication; a MIDI processing unit 24 for processing the MIDI signal; and a controller 25 for carrying out the control of the overall operation.

The input unit 21 outputs an input signal to the controller 25. The input signal is typically a recital signal representative of a note or a tune that may be obtained from a musical instrument.

The output unit 22 displays, by inputting display data corresponding to the input signal in accordance with the control of the controller 25, or outputs the sound inputted by voice data.

The memory 23 stores many kinds of data inputted and outputted when performing a predetermined program for controlling the overall operation of the terminal and a control operation of the terminal.

The communication processing unit 27 performs communication under the control of the controller 25. The communication processing unit 27 can communicate with a server of a corresponding communication network in a predetermined method. The communication method may use a Bluetooth, or a Wi-Fi protocol. Bluetooth and Wi-Fi protocols are well-known in the art and need not be described in detail herein.

The MIDI processing unit 24 outputs a corresponding MIDI signal to the communication unit 27 after generating the corresponding MIDI signal related to a recital signal of a corresponding musical instrument input from the input unit 21. Also, the MIDI processing unit 24 converts a corresponding sound source of a MIDI signal received from a server into a sound of a corresponding musical instrument, and outputs the sound to the output unit 22.

The controller 25 generally controls the overall system, performs a function to control and coordinate a series of processes that transmits its result to the output unit 22 after inputting and processing the material from the input unit 21. Also, the controller 25 operates so that the MIDI signal outputted from the MIDI processing unit 24 can be transmitted through the communication unit 27 to the server. Also, the controller 25 operates so that an MIDI signal received from the server through the communication unit 27 can be output to the MIDI processing unit 24.

Figure 3:
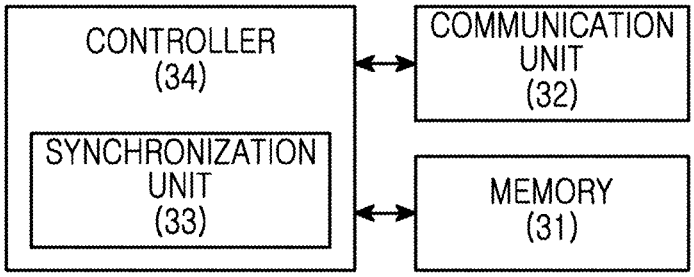
FIG. 3 is a block diagram of server according to an embodiment of the present invention.

FIG. 3 is a block diagram of server according to an embodiment of the present invention.

Referring to FIG. 3, the server includes a memory 31 for storing data; a communication unit 32 providing communication over a network; a synchronization unit 33 for synchronizing the MIDI signal(s); and a controller 34 for performing the control of the overall operation.

The memory 31 stores many kinds of data inputted and outputted when performing a predetermined program for controlling the overall operation of the server and a control operation of the server. Also, the memory 31 stores a MIDI signal provided by the terminal.

The communication unit 32 performs the communication between terminals under the control of the controller 34.

The controller 34 generally controls the system, outputs a synchronized MIDI signal of an unspecified terminal received from the communication unit 32 to the synchronization unit 33, and outputs the synchronized MIDI signal to the communication unit 32 so that a synchronized MIDI signal outputted from the synchronization unit 33 can be transmitted to all terminals.

Figure 4:
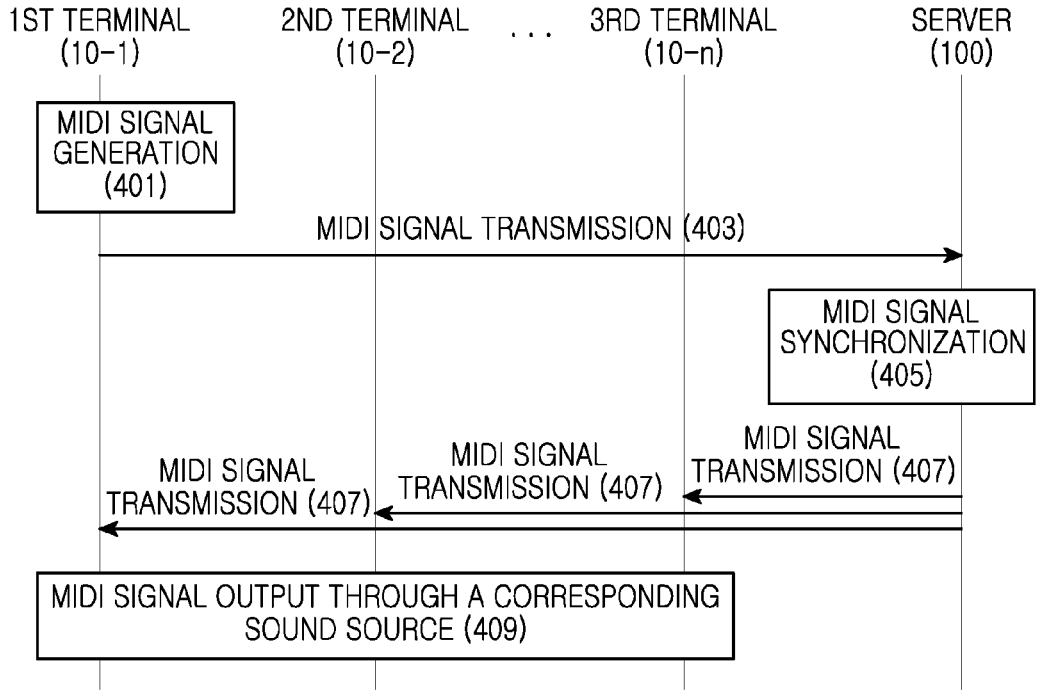
FIG. 4 is a flowchart of remote concert system according to an embodiment of the present invention.

FIG. 4 is a flowchart of remote concert system according to an embodiment of the present invention.

Referring to FIG. 4, if a first terminal 10-1 inputs a recital signal of a corresponding musical instrument, the first terminal generates a MIDI signal corresponding to the recital signal (Step 401).

After this time, the first terminal 10-1 transmits a generated MIDI signal to the server 100 of a corresponding communication network (Step 403).

The server 100 synchronizes the MIDI signal received from the first terminal 10-1 (Step 405).

After this time, the server 100 transmits the synchronized MIDI signal to all terminals 10-1, 10-2, 10-3 . . . 10-N for ensemble playing by all the terminals (Step 407).

Each of the terminals 10-1, 10-2, 10-3 . . . 10-N outputs the MIDI signal from the server 100 through a corresponding sound source (Step 409).

Figure 5:
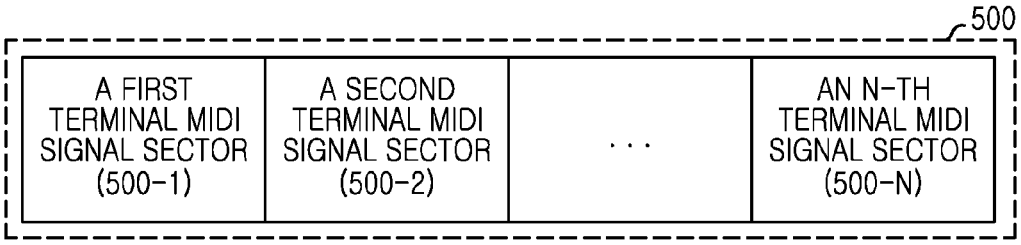
FIG. 5 is a united MIDI signal which a server sends to terminals.

FIG. 5 illustrates an example of a united MIDI signal which server sends to terminals.

Referring to FIG. 5, the server recognizes terminals connected to a network for ensemble playing, and transmits an united MIDI signal 500 including sectors 500-1, 500-2, . . . , 500-N for distinguishing from a MIDI signal of respective terminal. For example, if the first terminal receives the MIDI signal at a particular time, the server transmits the united MIDI signal existing in a corresponding sector 500-1 to all terminals. That is, the first terminal inputs and sends a MIDI signal to the server. Then the server makes the united MIDI signal consisting of the MIDI signal from the first terminal only in first sector designated to the first terminal. The each terminal play a sound by activating the stored sound source which may be Pulse Code Modulation file corresponding to MIDI signal after receiving the united MIDI signal from the server.

Also, in case of simultaneously receiving MIDI signals from at least two or more terminals at a particular time, the server transmits the united MIDI signal, which includes the received MIDI signals in corresponding sectors associated with each terminal. That is, the first terminal and the second terminal send the respective MIDI signal simultaneously to the server. The server makes then the united MIDI signal consisting of two MIDI signals from the first and second terminals only in first and second sectors, respectively Each sector of the united MIDI signal can be designated a corresponding sound source which may be a Pulse Code Modulation file. In summary, if the first terminal inputs a MIDI signal, then the MIDI signal from the first terminal is sent to each of the terminals in the first slot of the united MIDI signal via the server. If there are two signals from two terminals, then the united MIDI signal includes two slots, one for each signal received. Each terminal scans the united MIDI signal to determine which MIDI signal slot is occupied and then plays those sounds associated with the two signals.

The terminal plays sounds associated with the occupied MIDI signals. Here, the sounds are performed by activating the stored sound sources which may be Pulse Code Modulation files corresponding to MIDI signals.

Also, if the server determines a particular time delay for sound performance and set ups information for delay in the united MIDI signal, the performance may be delayed accordingly in the terminal. Further, the delay of performance may be predetermined by a predetermined time period among the joining terminals. This kind of delay set up may be made by using a software method known in this technical field.

Figure 6:
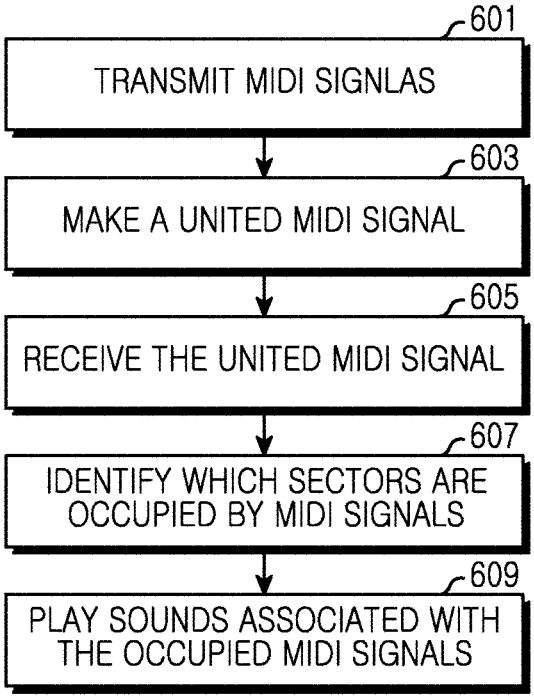
FIG. 6 is a flow chart of a remote concert method employing two terminals and a server according to an embodiment of the present invention.

FIG. 6 is a flow chart of a remote concert method employing two terminals and a server according to an embodiment of the present invention. Referring 6, in a step of 601, two terminals 10-1 and 10-2 send the respective MIDI signals to the server 100.

In a step of 603, the server receiving the two MIDI signals from the respective two terminals makes a united MIDI signal.

In a step of 605, each terminal 10-1 and 10-2 receives the united MIDI signal from the server.

In a step of 607, the each terminal identifies which sectors are occupied by MIDI signals.

Then, the each terminal plays sounds associated with the occupied MIDI signals. As stated above, the sounds are performed by combination of each stored Pulse Code Modulation file corresponding to each MIDI signal among the MIDI signals.

Also, the performance of sound may be delayed by a particular time period determined by the server or by a predetermined time period scheduled among the joining terminals using a software method known in this technical field.

As a result, the method and system for remote concert using the communication network according to the present invention is capable of creating an ensemble of musical instruments in real time with no limitation regarding the place the musicians (terminals) are located at The above-described methods according to the present invention can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

On the other hand, while the present invention has been particularly shown and described with reference to exemplary embodiments thereof, it will be understood by those skilled in the art that various changes in form and details may be made therein without departing from the spirit and the scope of the present invention as defined by the appended claims.

What is claimed is:

1. A remote concert system using a communication network, comprising:

a server; and a plurality of terminals connected to the server, wherein at least one terminal transmits a Musical Instrument Digital Interface (MIDI) signal to the server after generating the MIDI signal in accordance with an input of a recital signal, wherein the server recognizes the plurality of terminals for ensemble playing, receives the MIDI signals from the recognized plurality of terminals, generates a united MIDI signal from the received MIDI signals, and transmits the united MIDI signal to each of the plurality of terminals wherein the received MIDI signals are transmitted in each predetermined sector for distinguishing the respective terminal within the united MIDI signal, and wherein each of the recognized plurality of terminals receives the united MIDI signal from the server and outputs a sound associated with the united MIDI signal.

2. The system of claim 1, wherein the server transmits the united MIDI signal including at least two MIDI signals to each of the plurality of terminals when simultaneously receiving the at least two MIDI signals.

3. The system of claim 2, wherein each of the recognized plurality of terminals simultaneously outputs the simultaneously received and united MIDI signal via a corresponding sound source.

4. The system of claim 1, wherein the communication network is a Bluetooth communication network or a Wi-Fi communication network.

5. A method of performing a remote ensemble using a server and a plurality of terminals connected to the server via a communication network, comprising:

connecting a plurality of terminals for ensemble playing to the server via the communication network;

sending Musical Instrument Digital Interface (MIDI) signals to the server after generating the MIDI signals in accordance with the input of recital signal in a plurality of the terminals;

recognizing, at the server, the plurality of terminals for ensemble playing;

receiving, at the server, the MIDI signals from the recognized plurality of terminals;

generating, at the server, a united MIDI signal from the received MIDI signals from the recognized plurality of terminals, wherein the received MIDI signals are included in each predetermined sector for distinguishing the respective terminal within the united MIDI signal;

transmitting, at the server, the united MIDI signal to all of the recognized plurality of terminals;

receiving, at each of the recognized plurality of terminals, the united MIDI signal from the server, and outputting, at each of the recognized plurality of terminals, a sound associated with the united MIDI signal.

6. The method of claim 5, further comprising:

transmitting, at the server, the united MIDI signal including at least two MIDI signals to each of the recognized plurality of terminals when simultaneously receiving the at least two MIDI signals.

7. The method of claim 6, further comprising:

simultaneously outputting, at each of the recognized plurality of terminals, the simultaneously received and united MIDI signal via the corresponding sound source.

8. The method of claim 5, wherein the communication network is a Bluetooth network or a Wi-Fi network.

9. A terminal comprising:

a communication unit;

a controller configured to control to:

receive an instrumental signal input;

convert the received instrumental signal to a Musical Instrument Digital Interface (MIDI) signal;

transmit the MIDI signal through the communication unit from a server;

receive a united MIDI signal through the communication unit from the server, wherein the united MIDI signal generated by the server includes MIDI signals from a plurality of ensemble terminals including the terminal, and the MIDI signals are in each predetermined sector for distinguishing the respective terminal within the united MIDI signal; and output a sound according to the united MIDI signal.

10. The terminal of claim 9, the MIDI signals are communicated via a communication network which is one of Bluetooth communication network and a Wi-Fi communication network.

11. A method of communicating a Musical Instrument Digital Interface (MIDI) signal in a communication terminal comprising:

receiving an instrumental signal input;

converting the received instrumental signal to a MIDI signal transmitting the MIDI signal to a server;

receiving a united MIDI signal from the server, wherein the united MIDI signal generated by the server includes MIDI signals from a plurality of communication terminals including the communication terminal, and the MIDI signals are in each predetermined sector for distinguishing the respective terminal within the united MIDI signal; and outputting a sound according to the united MIDI signal.

12. The method of claim 11, the MIDI signals are communicated via a communication network which is one of Bluetooth communication network and a Wi-Fi communication network.

* * * * *